United States Patent [19]

Gurr

[11] 4,217,181

[45] Aug. 12, 1980

[54] RECOVERY OF URANIUM OXIDES BY ELECTROLYSIS

[75] Inventor: William R. Gurr, Berkshire, England

[73] Assignee: National Research Development Corporation, London, England

[21] Appl. No.: 914,223

[22] Filed: Jun. 9, 1978

[51] Int. Cl.[2] ..... C25C 1/22

[52] U.S. Cl. ..... 204/1.5; 204/212

[58] Field of Search ..... 204/1.5; 252/301.1 R; 423/11

[56] References Cited

U.S. PATENT DOCUMENTS

| | | | |
|---|---|---|---|
| 2,581,863 | 1/1952 | Kahn | 204/1.5 |
| 2,832,728 | 4/1958 | Kunin | 204/1.5 |
| 3,143,483 | 8/1964 | Le Bris et al. | 204/1.5 |

FOREIGN PATENT DOCUMENTS

| | | |
|---|---|---|
| 802452 | 10/1958 | United Kingdom . |
| 854122 | 11/1960 | United Kingdom . |
| 1007662 | 10/1965 | United Kingdom . |
| 1444367 | 8/1976 | United Kingdom . |

*Primary Examiner*—Leland A. Sebastian

*Attorney, Agent, or Firm*—Lane, Aitken, Ziems, Kice & Kananen

[57] ABSTRACT

A method of extracting uranium oxide from a solution of one or more uranium compounds, e.g. leach liquors, comprising subjecting the solution to electrolysis utilizing a high current density, e.g. 500 to 4000 amp/m$^2$, whereby uranium oxide is formed at the cathode which is recovered. The method is particularly suited to a continuous process using a rotating cathode cell.

7 Claims, 2 Drawing Figures

RECOVERY OF URANIUM OXIDES BY ELECTROLYSIS

This invention relates to the recovery of uranium oxides from a solution containing uranium compounds and in particular to the recovery of uranium oxide from leach liquors.

BACKGROUND TO THE INVENTION

The present plant practice for the production of uranium oxides from uranium-bearing ores involves a complex, multi-stage operation. The ores, which generally contain uranium in an amount of 200 to 1000 ppm undergo a primary crushing followed by fine grinding normally to a particle size of 200 mesh. The finely ground ore is mixed with a lixiviant to form a slurry and allowed to react to extract the uranium from the ore into solution in the lixiviant. The normal lixiviants are dilute sulphuric acid or an alkali, e.g. sodium or ammonium carbonate.

The pregnant leach liquors are purified and concentrated by ion exchange and/or solvent extraction followed by chemical treatment to precipitate the diuranate. The solid diuranate is separated from the liquid and calcined to yield the uranium oxide, known as yellow cake.

OBJECT OF THE INVENTION

It is an object of the present invention to provide a process for recovering uranium oxides from solutions containing uranium compounds.

BRIEF SUMMARY OF THE INVENTION

Therefore according to the invention there is provided a method of extracting uranium oxide from a solution of one or more uranium compounds in which the solution is subjected to electrolysis utilizing a high current density to form solid uranium oxide at the cathode which is recovered.

The process of the present invention may be used to separate uranium oxide from both dilute or concentrated solutions containing soluble compounds of uranium. The process is particularly suitable for the recovery of uranium oxide from leach liquors which generally have a concentration of uranium of 100 to 3000 ppm or from ion exchange or solvent extraction strip liquors up to 30,000 ppm, the uranium oxide forming as a powder and the lixiviant being proportionally regenerated so it may be reused.

The current density used in the electrolysis is high, normally in the region of 500 to 4000 amp/m$^2$. In order to achieve optimum recovery of the solution there should be a high relative electrode/liquid velocity, particularly when the solutions are dilute.

In a preferred embodiment of the invention the solution containing uranium compounds is continuously passed through a rotating cathode cell operating at a current density in the region of 2000 to 2500 amp/m$^2$ and the uranium oxide particles which are formed are removed from the cell as a dispersion and separated by conventional solid-liquid separation techniques.

DESCRIPTION OF THE DRAWINGS

The invention will now be illustrated with reference to the accompanying drawings, in which.

DESCRIPTION OF THE PREFERRED EMBODIMENT

Figure 1:
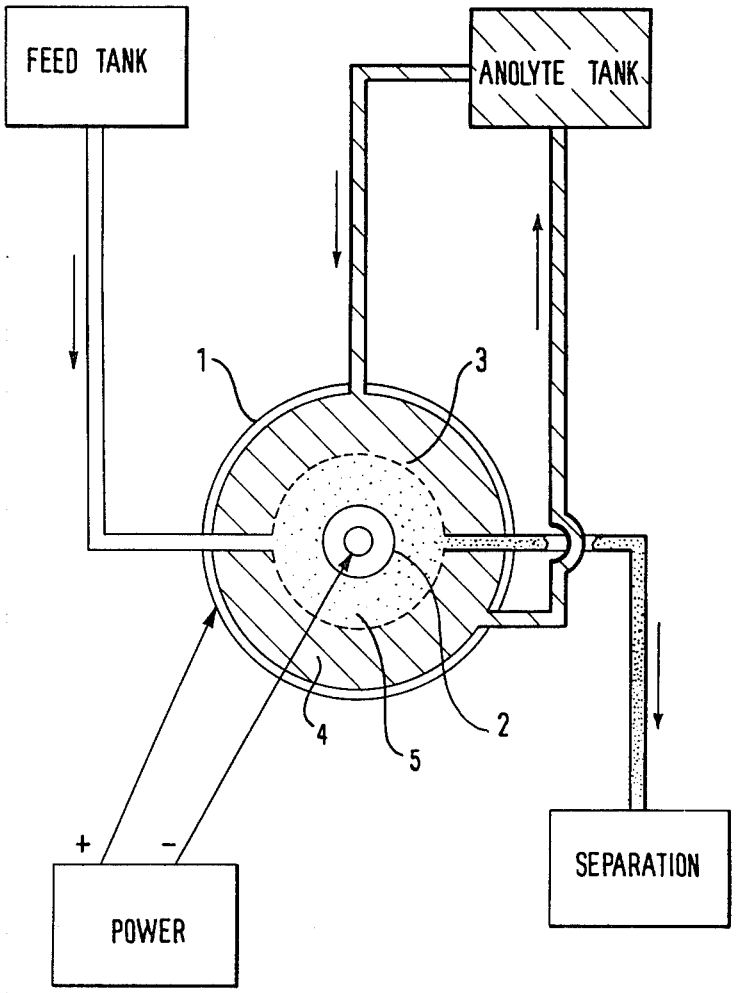
FIG. 1 represents a typical electrolysis cell arrangement for use in the invention.

The process of the invention is preferably conducted in a rotating cathode cell, for example, as illustrated in FIG. 1. Typically, the cell comprises a cylindrical casing which could be made of titanium, forming the anode 1 and a centrally positioned cylindrical cathode 2, e.g. of stainless steel, which is rotated; alternatively the anode may be a separate structure within a containing vessel. An ion permeable diaphragm 3 is positioned between the anode and cathode which prevents corrosion of the anode and divides the cell into two portions, an anode region 4 and cathode region 5.

The solution containing the uranium compounds e.g. a leach liquor, is passed from a feed tank into the cathode region 5 where uranium oxide particles are formed on the rotating cathode. These particles are continually removed from the cathode by turbulent boundary flow or with a scraper and form a dispersion in the liquor. The dispersion is continuously removed from the cathode region and passed to a separator where the uranium oxide is separated by conventional solid-liquid separation techniques.

The dispersion of uranium oxides removed from the cell may be passed through a gas separator to remove any hydrogen gas evolved at the cathode and then through hydrocyclones to remove a substantial part of the liquor. The concentrated slurry may then be passed to a settling tank from which the uranium oxides are removed and excess liquor recycled.

An anolyte is continually passed through the anode compartment. The choice of anolyte depends upon the solution of uranium compounds, for example, in the case of sulphuric acid being used as the lixiviant the anolyte may be pure sulphuric acid.

The cell is operated at a high current density, for example, in the region of 2500 amp/m$^2$. The quantity of uranium which is capable of being extracted by the cell is dependent upon the current density and not on the rate of flow of the solution. Thus, a cell will always extract the same quantity of uranium each hour providing this amount of uranium is contained in the solution passing through the cell in an hour. In practice the leach liquor is normally passed through the cell as fast as the operating conditions will allow.

Current efficiencies in excess of 75% with production rates of over 2.0 kg/1000 amp hours are obtainable.

The elctrolysis process is a continuous operation and may be used for both dilute and concentrated solution. The leach liquors may be treated down to a uranium content of 2 ppm and therefore the extraction is very efficient.

Figure 2:
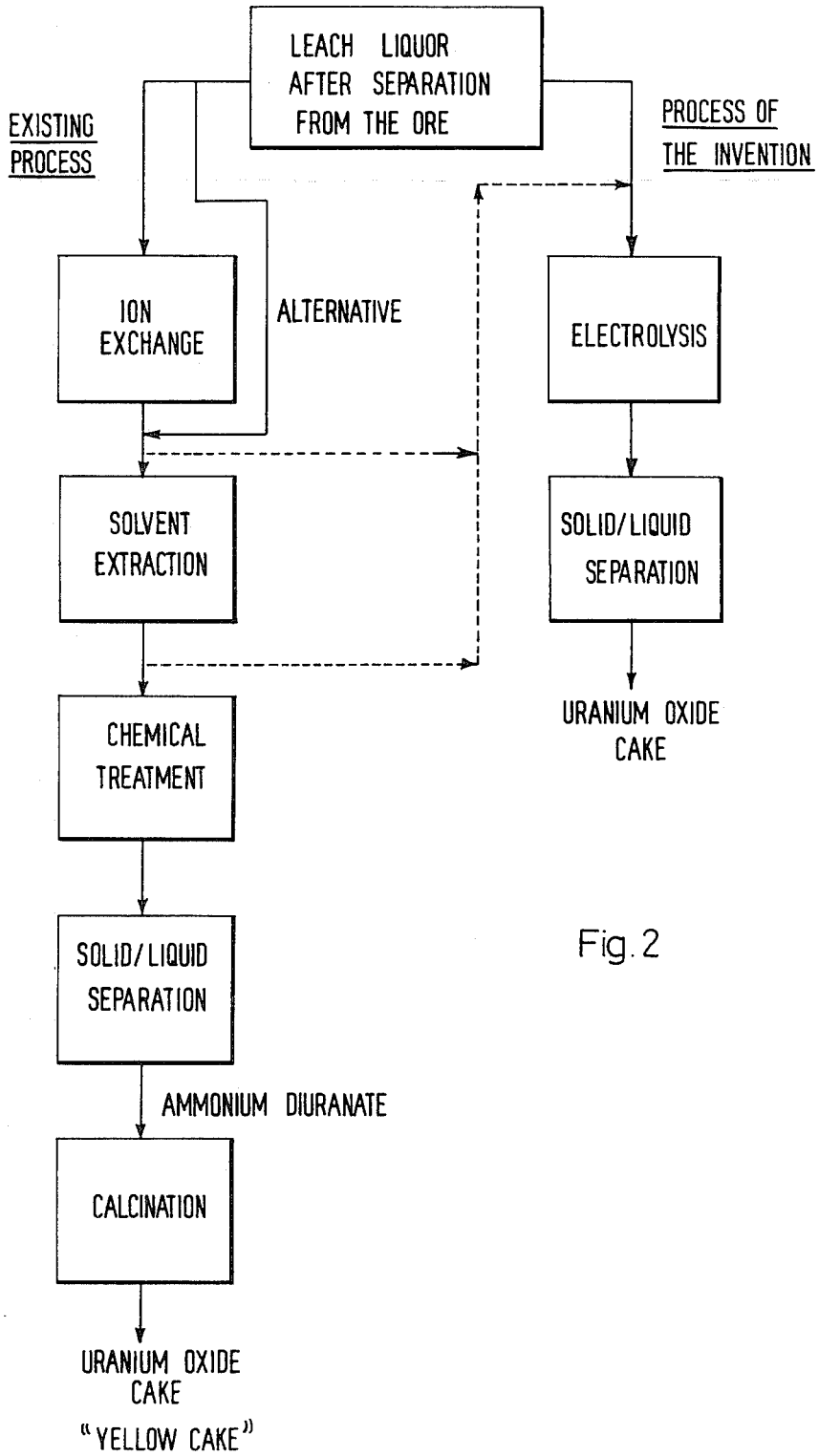
FIG. 2 represents flow diagrams comparing a prior process for the extraction of uranium oxide with that of the present invention.

FIG. 2 of the drawings represents a flow diagram comparing the process of the invention with the existing process. It will be seen that the process of the invention avoids the complex, multi-stage operation of the prior art.

I claim:

1. A method of extracting uranium oxide from a solution of uranium compounds comprising the steps of:

(a) providing a solution of uranium compounds, (b) subjecting said solution to electrolysis utilizing a high current density from about 500 to about 4000 amp/m$^2$ wherein the electrolysis is conducted in a rotating cathode cell, whereby uranium oxide is formed at the cathode, and (c) recovering the uranium oxide.

2. A method according to claim 1 wherein the current density is from about 2000 to 2500 amp/m$^2$.

3. A method according to claim 1 wherein said solution is passed continuously into said cell whereby a dispersion of uranium oxide is formed which is continuously removed from said cell and thereafter said uranium oxide separated from said dispersion.

4. A method according to claim 3 wherein said rotating cathode cell comprises a cathode adapted to rotate an anode and an ion permeable membrane positioned between said anode and cathode and dividing said cell into an anode region and a cathode region, said anode region containing an anolyte and said solution of uranium compounds being fed into said cathode region.

5. A method according to claim 4 wherein said anolyte is sulphuric acid.

6. A method according to claim 3 wherein said solution of uranium compounds is selected from the group consisting of leach liquors, ion exchange strip liquors or solvent extraction strip liquors.

7. A method of extracting uranium oxide from a solution of uranium compounds comprising the steps of:

(1) providing a solution of compounds of uranium, (2) continuously introducing said solution into a cathode region of a rotating cathode cell, said cell comprising a cathode adapted to rotate, an anode and an ion permeable membrane positioned between said anode and cathode and dividing said cell into a cathode region and an anode region, (3) introducing an anolyte into said anolyte region, (4) providing a current density of about 2000 to 2500 amp/m$^2$ in said cell and rotating said cathode whereby particles of uranium oxide are formed at said cathode and are displaced from said cathode to form a dispersion of uranium oxide particles, (5) continuously removing said dispersion from said cell, and (6) separating said uranium oxide particles from said dispersion.

* * * * *